US006031707A

United States Patent [19]

Meyer

[11] Patent Number: 6,031,707

[45] **Date of Patent: *Feb. 29, 2000**

[54] METHOD AND APPARATUS FOR CONTROL OF CURRENT RISE TIME DURING MULTIPLE FUEL INJECTION EVENTS

[75] Inventor: William D. Meyer, Columbus, Ind.

[73] Assignee: Cummins Engine Company, Inc., Columbus, Ind.

[ * ] Notice: This patent issued on a continued prosecution application filed under 37 CFR 1.53(d), and is subject to the twenty year patent term provisions of 35 U.S.C. 154(a)(2).

[21] Appl. No.: 09/027,869

[22] Filed: Feb. 23, 1998

[51] Int. Cl.[7] ..... H01H 47/28

[52] U.S. Cl. ..... 361/153; 361/154

[58] Field of Search ..... 361/139, 154, 361/152, 153, 155, 156, 187, 191; 123/294

[56] References Cited

U.S. PATENT DOCUMENTS

| | | | |
|---|---|---|---|
| 4,040,397 | 8/1977 | Leichle | 123/32 |
| 4,338,651 | 7/1982 | Henrich | 361/154 |
| 4,377,144 | 3/1983 | Takahashi | 123/490 |
| 4,452,210 | 6/1984 | Sasayama et al. | 123/490 |
| 4,486,703 | 12/1984 | Henrich | 323/222 |
| 4,605,983 | 8/1986 | Harvey | 361/154 |
| 4,729,056 | 3/1988 | Edwards et al. | 361/153 |
| 4,774,624 | 9/1988 | Qualich | 361/159 |
| 4,933,805 | 6/1990 | Calfus | 361/152 |
| 4,978,965 | 12/1990 | Hartmann et al. | 307/140 |
| 5,092,302 | 3/1992 | Mohan | 123/497 |
| 5,267,545 | 12/1993 | Kitson | 123/490 |
| 5,381,297 | 1/1995 | Weber | 361/153 |
| 5,469,825 | 11/1995 | Golab et al. | 123/479 |
| 5,531,198 | 7/1996 | Matsuura | 123/294 |
| 5,717,562 | 2/1998 | Antone et al. | 361/155 |

*Primary Examiner*—Jeffrey Gaffin
*Assistant Examiner*—Kim Huynh
*Attorney, Agent, or Firm*—Woodard, Emhardt, Naughton Moriarty & McNett Patent and Trademark Attorneys

[57] ABSTRACT

The present invention relates to a method and apparatus for control of current rise time during multiple fuel injection events. The invention utilizes a single boost voltage supply circuit, in which the boost capacitor is designed to store slightly more than twice the total energy required to pull-in a single fuel injector solenoid during the prescribed time. A reference waveform simulating the desired current rise time is compared to the actual boost voltage produced by the circuit. The boost voltage is modulated (switched on and off) in order to maintain the boost voltage within a predetermined window around the reference waveform. This modulation will compensate for any droop in boost voltage at the time of actuation, and will also compensate for two solenoids being actuated at the exact same time. It is only necessary that a nninimum amount of energy be stored in the boost capacitor at the completion of an actuation event, and the level of this minimum amount of energy can easily be determined by analysis or experimentation. Additionally, it is very easy to modify the shape and duration of the reference waveform, thus allowing for a very flexible solenoid drive circuit whose pull-in time and boost energy consumption can be easily changed to meet the requirements of an application without modifying the LRC time constants of the system.

16 Claims, 2 Drawing Sheets

METHOD AND APPARATUS FOR CONTROL OF CURRENT RISE TIME DURING MULTIPLE FUEL INJECTION EVENTS

TECHNICAL FIELD OF THE INVENTION

The present invention generally relates to electromechanical fuel injection control systems and, more particularly, to a method and apparatus for control of current rise time during multiple fuel injection events.

BACKGROUND OF THE INVENTION

Fuel injectors in internal combustion engines must be capable of injecting precisely controlled quantities of fuel into the combustion chambers of the engine. Each injector delivers fuel through an outlet valve, and as long as the outlet valve is fully open, the injector can be assumed to deliver fuel at a constant rate. If the valve were always either fully open or fully closed, then the quantity of fuel delivered would be strictly proportional to the period during which the valve is open. But in reality, the valve takes a certain length of time to open fully and consequently the proportionality remains strictly true only as long as the valve opens with the same rapidity each time.

In electromagnetic fuel injectors, the valve is opened by an electromagnetic solenoid coil. A coil of this kind exhibits a certain auto-inductance, with the result that the current flowing through the coil builds up following an exponential curve when a constant driving voltage is applied. The slope at the beginning of this curve is a function of the applied voltage. For rapid operation of the injector, the current in the solenoid coil should be allowed to rise quickly enough to produce a high magnetic flux in the magnetic core of the device at least sufficient to cause the armature of the device to start moving. The current is then allowed to rise to a peak value within a predetermined time period, during which the armature completes its movement.

Repeatability is also a requirement for electromagnetic fuel injector control systems. Being able to repeatedly transition from zero to a predetermined current level within a tolerance of several microseconds is a requirement for many fuel control systems. Such repeatability is typically achieved by using a boost voltage supply to drive the solenoid coil. The boost voltage supply typically consists of a DC-DC converter which stores energy in a capacitor at a fixed voltage. The boost capacitor is then discharged into the injector solenoid. Because the boost capacitor is always fully charged to a predetermined fixed voltage prior to discharge, the pull-in current waveform is very repeatable.

It has been found that a considerable performance benefit can be realized by double pulsing the fuel injection solenoid within a single cylinder cycle. This mode of operating an engine dictates that in some operating conditions it is necessary to energize two solenoids simultaneously or within a very short time period of one another. With the boost voltage supply and driver circuitry used in prior art systems, this is not always possible. For example, a typical prior art system will employ a boost capacitor that is charged to approximately 100 volts, and then discharged into a solenoid until the current has reached 7.5 amps. For a typical prior art fuel injector solenoid, the pull-in time to 7.5 amps is approximately 150 microseconds. It then takes several milliseconds for the boost power supply to refresh the boost capacitor to 100 volts. If an attempt to energize another injector is made during the boost capacitor "refresh" time, the pull-in time to 7.5 amps will be considerably greater than the desired time, and will vary depending upon the exact operating conditions of the system. Such inconsistency in fuel injector opening times is -unacceptable in most applications.

One possible solution to this problem is to use two identical boost voltage supplies, wherein one of these supplies should always be completely refreshed. The engine control module (E.C.M.) would then commutate the refreshed voltage supply to the fuel injector to be energized. In this manner, the second voltage supply could be refreshed while the other voltage supply is being utilized. However, this solution is undesirable due to the added cost and space required for the second boost voltage supply, and due to the added complexity required to commutate the two boost voltage supplies correctly.

There is therefore a need for a means to energize two solenoids simultaneously or within a very short time period of one another without requiring redundant voltage supplies. The present invention is directed toward meeting this need.

SUMMARY OF THE INVENTION

The present invention relates to a method and apparatus for control of current rise time during multiple fuel injection events. The invention utilizes a single boost voltage supply circuit, in which the boost capacitor is designed to store slightly more than twice the total energy required to pull-in a single fuel injector solenoid during the prescribed time. A reference waveform simulating the desired current rise time is compared to the actual boost voltage produced by the circuit. The boost voltage is modulated (switched on and off) in order to maintain the boost voltage within a predetermined window around the reference waveform. This modulation will compensate for any droop in boost voltage at the time of actuation, and will also compensate for two solenoids being actuated at the exact same time. It is only necessary that a minimum amount of energy be stored in the boost capacitor at the completion of an actuation event, and the level of this minimum amount of energy can easily be determined by analysis or experimentation. Additionally, it is very easy to modify the shape and duration of the reference waveform, thus allowing for a very flexible solenoid drive circuit whose pull-in time and boost energy consumption can be easily changed to meet the requirements of an application without modifying the LRC time constants of the system.

In one form of the invention, an apparatus for control of current rise time during multiple fuel injection events is disclosed, comprising: a solenoid having a first solenoid terminal and a second solenoid terminal; a sense resistor coupled to the second solenoid terminal and operable to generate a sense voltage proportional to a current flowing through the solenoid; a boost modulation reference pulse generator operable to generate an output reference voltage pulse having an envelope proportional to a desired solenoid current pulse; a comparator having a first comparator input terminal coupled to the sense voltage, a second comparator input terminal coupled to the output reference voltage pulse, and a comparator output; a boost voltage supply; and a switch having a first switch terminal coupled to the boost voltage supply, a second switch terminal coupled to the first solenoid terminal, and a switch control terminal operatively coupled to the comparator output; wherein a voltage signal present on the comparator output is operative to close the switch, thereby coupling the boost voltage supply to the first solenoid terminal.

In another form of the invention an apparatus for control of current rise time in a solenoid having first and second solenoid terminals is disclosed, the apparatus comprising: a sense resistor coupled to the second solenoid terminal and operable to generate a sense voltage proportional to a current flowing through the solenoid; a boost modulation reference pulse generator operable to generate an output reference voltage pulse having an envelope proportional to a desired solenoid current pulse; a comparator having a first comparator input terminal coupled to the sense voltage, a second comparator input terminal coupled to the output reference voltage pulse, and a comparator output; a boost voltage supply; and a switch having a first switch terminal coupled to the boost voltage supply, a second switch terminal coupled to the first solenoid terminal, and a switch control terminal operatively coupled to the comparator output; wherein a voltage signal present on the comparator output is operative to close the switch, thereby coupling the boost voltage supply to the first solenoid terminal.

In another form of the invention a method for control of current rise time during multiple fuel injection events is disclosed, comprising the steps of: a) providing a solenoid-operated fuel ejector; b) providing a boost voltage supply; c) sensing a voltage proportional to a current flowing in the solenoid; d) generating a boost modulation reference voltage pulse having an envelope proportional to a desired solenoid current pulse; e) comparing the sensed voltage to the reference voltage pulse; f) coupling the boost voltage supply to the solenoid whenever the reference voltage pulse exceeds the sensed voltage; and g) de-coupling the boost voltage supply from the solenoid whenever the sensed voltage exceeds the reference voltage pulse.

DESCRIPTION OF THE PREFERRED EMBODIMENT

Figure 1:
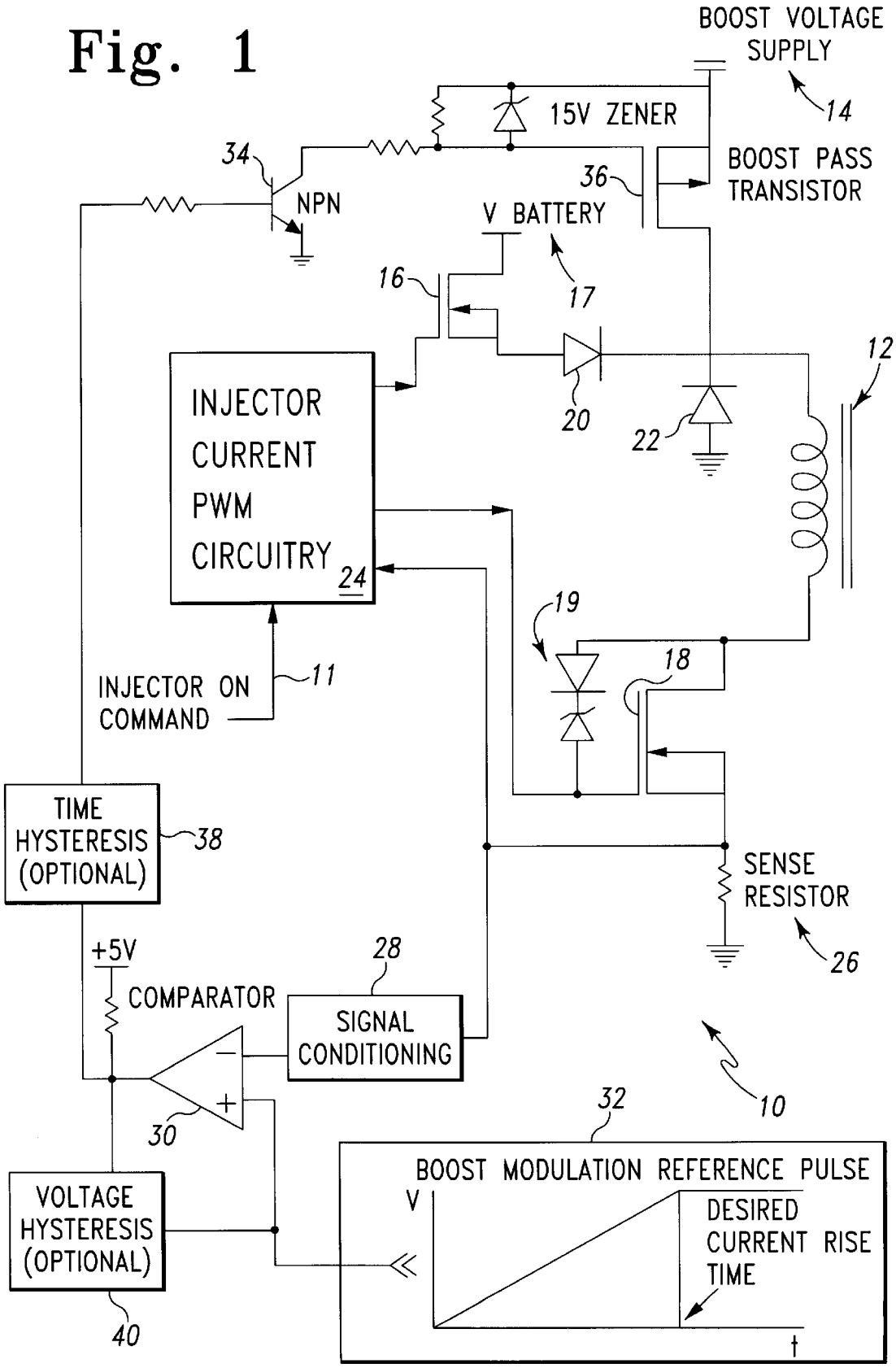
FIG. 1 is a schematic circuit diagram of a preferred embodiment boost voltage supply circuit of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modification in the illustrated device, and such further applications of the principles of the invention as illustrated therein being contemplated as would normally occur to one skilled in the art to which the invention relates.

Referring to FIG. 1, there is illustrated a schematic diagram of a preferred embodiment fuel injector solenoid boost voltage supply circuit of the present invention, indicated generally at 10. The fuel injector solenoid 12 is energized by current flowing from a boost voltage supply capacitor 14 and/or battery 17 to ground. A command 11 is given to the boost voltage supply circuit 10 from the vehicle engine control module (ECM) which commands the circuit 10 to turn on the fuel injector (i.e., energize the solenoid 12). The command is input to a fuel injector current pulse width modulation (PWM) circuit 24 which is used to regulate the current through the solenoid by pulse width modulation, as it known in the art. The PWM circuitry 24 immediately turns on the transistor 16 and the transistor 18. The transistor 18 is used to attach the solenoid 12 to ground through the sense resistor 26. The transistor 18 provides a redundant mechanism for disabling current flow through the solenoid and also allows for rapid current discharge, in combination with the diode/zener pair 19. The main purpose of the transistor 16 is to couple the battery voltage supply 17 to the solenoid 12 in order to modulate the battery voltage 17 (under control of the PWM circuitry 24) across the solenoid 12 after the boosted rise, as is known in the prior art.

The sense resistor 26 is placed in the path of the current flowing through the fuel injector solenoid coil 12, and thereby establishes a sense voltage proportional to the current flowing through the coil 12. This sense voltage is filtered by signal conditioning circuitry 28, such as a low pass filter, and then applied to one input of a comparator 30. The sense voltage is also fed back to the PWM circuitry 24. The other input to comparator 30 comprises a boost modulation reference pulse 32 which is a voltage pulse exhibiting the same shape and timing as the desired current ramp-up of the current flowing through the solenoid coil 12. The boost modulation reference pulse 32 is started under control of the PWM circuitry 24 (connection not shown) when the injector-on command 11 is received.

At any time that the sense voltage is less than the voltage of the reference pulse 32, the output of the comparator 30 will be high, thus turning on transistors 34 and 36. Activation of the boost pass transistor 36 allows the voltage of the boost voltage supply capacitor 14 to be applied to the solenoid coil 12. thereby providing an increase to the current flowing through the solenoid coil 12. As this current increases, the sense voltage dropped across the sense resistor 26 increases correspondingly, until such time that the sense voltage exceeds the boost modulation reference pulse voltage. At this time, the comparator 30 switches to a low output, thereby turning off transistors 34 and 36, which in turn decouples the boost voltage supply capacitor 14 from the solenoid coil 12.

Figure 2:
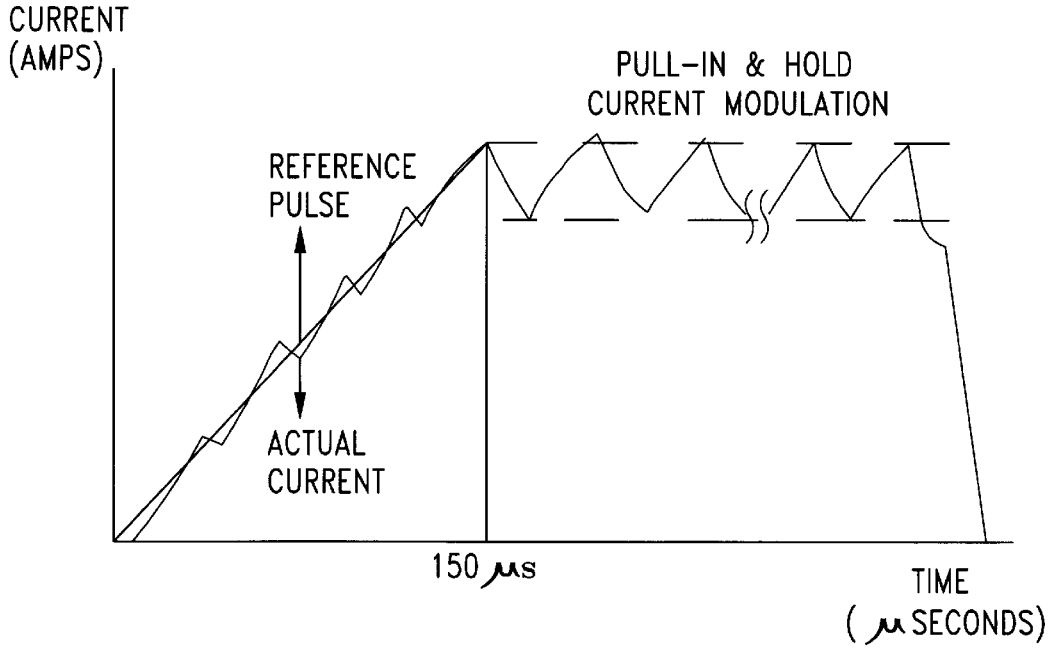
FIG. 2 is a graph of current v. time illustrating the reference waveform and actual circuit output waveform using the circuit of FIG. 1.

When the boost pass transistor 36 is turned off, the only current supplied to the solenoid coil 12 is from the battery 17 through the transistor 16. The current thus supplied is not enough to allow the solenoid coil 12 current to continue to increase at a rate greater than the boost modulation reference pulse 32, thus the increasing voltage of the reference pulse 32 eventually overtakes the sense voltage provided by the sense resistor 26. At this point, the comparator 30 once again produces a high output, thereby turning on the transistors 34 and 36. Activation of the boost pass transistor 36 once again couples the boost voltage supply capacitor 14 to the solenoid coil 12, thereby continuing to ramp-up the current therein. This cycle continues to repeat, thereby causing the current in the solenoid coil 12 to be modulated about the desired shape established by the boost modulation reference pulse 32. This can be seen in the graph of FIG. 2, which illustrates the current flowing through the solenoid coil 12 versus time. It can be seen that activation of the reference pulse 32 upon receipt of the injector-on command 11 will immediately cause the transistors 34 and 36 to turn on, as the sense voltage will be zero.

The blocking diode 20 is provided to prevent the boost supply 14 from discharging through the body diode of the transistor 16. The recirculating diode 22 is used for PWM control of the current, as is known in the prior art. The inclusion of the blocking diode 20 effectively prevents the battery voltage 17 from being applied to the solenoid 12 at times when the boost supply voltage 14 is coupled through the boost pass transistor 36.

It is desirable to incorporate some form of hysteresis in the control loop between the comparator 30 and the transistors 34 and 36 in order to ensure that the loop is stable and does not oscillate. This is preferably implemented in the form of the optional time hysteresis block 30, which inserts a fixed time delay (e.g., 5 milliseconds) between the occurrence of an output on the comparator 30 and the application of an input to the transistor 34. Instead of the time hysteresis block 38, the control loop could instead use the voltage hysteresis block 40 to achieve the same stability, as is known in the art.

In order to utilize the circuitry of FIG. 1 to provide two pulses to a fuel injection solenoid within a single cylinder cycle, the boost voltage supply capacitor 14 must be capable of storing slightly more than twice the energy required to pull-in a single fuel injector solenoid during the prescribed time. A boost voltage supply capacitor 14 having a value of 22 microFarads and charged to a voltage of 120–140 volts will provide sufficient energy for a typical prior art fuel injector. The amount of energy needed to be stored in the boost voltage supply capacitor 14 for any particular fuel injector application can be easily determined by circuit analysis techniques or by simple experimentation.

The modulation supplied by the boost modulation reference pulse 32 and the comparator 30 will compensate for any droop in boost voltage at the time of solenoid 12 actuation, and will also compensate for the scenario in which the voltage supply circuit 10 is being used to actuate two fuel injector solenoids at the exact same time. For sequential firing of fuel injector solenoids, it is only required that the boost voltage supply capacitor 14 contain the minimum amount of energy required to pull-in the solenoid 12 at the end of the previous actuation event.

The circuitry 10 of FIG. 1 also provides the additional benefit I that the boost modulation reference pulse may be easily modified in both shape and duration, thereby making the circuit 10 a very flexible fuel injector solenoid drive circuit whose pull-in time can be easily changed to meet the requirements of a fuel injection application without modifying the LRC time constants of the system.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An apparatus for control of current rise time during multiple fuel injection events, comprising:

a solenoid having a first solenoid terminal and a second solenoid terminal;

a sense resistor coupled to the second solenoid terminal and operable to generate a sense voltage proportional to a current flowing through the solenoid;

a boost modulation reference pulse generator operable to generate an output reference voltage pulse having an envelope proportional to a desired solenoid current pulse;

a comparator having a first comparator input terminal coupled to the sense voltage, a second comparator input terminal coupled to the output reference voltage pulse, and a comparator output;

a boost voltage supply; and a switch having a first switch terminal coupled to the boost voltage supply, a second switch terminal coupled to the first solenoid terminal, and a switch control terminal operatively coupled to the comparator output;

wherein a voltage signal present on the comparator output is operative to close and open the switch, thereby coupling and decoupling, respectively, the boost voltage supply to the first solenoid terminal, wherein a rise-time and shape of an actual solenoid current pulse is forced to track the desired solenoid current pulse between zero and peak current.

2. The apparatus of claim 1, wherein the sense resistor is coupled between the second solenoid terminal and a ground potential.

3. The apparatus of claim 1, wherein the boost voltage supply comprises a capacitor.

4. The apparatus of claim 3, wherein the capacitor is capable of storing at least twice an amount of energy required to pull in the solenoid.

5. The apparatus of claim 1, wherein the switch comprises a field effect transistor, the first switch terminal comprises a drain of the transistor, the second switch terminal comprises a source of the transistor, and the switch control terminal comprises a gate of the transistor.

6. An apparatus for control of current rise time in a solenoid having first and second solenoid terminals, the apparatus comprising:

a sense resistor coupled to the second solenoid terminal and operable to generate a sense voltage proportional to a current flowing through the solenoid;

a boost modulation reference pulse generator operable to generate an output reference voltage pulse having an envelope proportional to a desired solenoid current pulse;

a comparator having a first comparator input terminal coupled to the sense voltage, a second comparator input terminal coupled to the output reference voltage pulse, and a comparator output;

a boost voltage supply; and a switch having a first switch terminal coupled to the boost voltage supply, a second switch terminal coupled to the first solenoid terminal, and a switch control terminal operatively coupled to the comparator output;

wherein a voltage signal present on the comparator output is operative to close and open the switch, thereby coupling and decoupling, respectively, the boost voltage supply to the first solenoid terminal, wherein a rise-time and shape of an actual solenoid current pulse is forced to track the desired solenoid current pulse between zero and peak current.

7. The apparatus of claim 6, wherein the sense resistor is coupled between the second solenoid terminal and a ground potential.

8. The apparatus of claim 6, wherein the boost voltage supply comprises a capacitor.

9. The apparatus of claim 8, wherein the capacitor is capable of storing at least twice an amount of energy required to pull in the solenoid.

10. The apparatus of claim 6, wherein the switch comprises a field effect transistor, the first switch terminal comprises a drain of the transistor, the second switch terminal comprises a source of the transistor, and the switch control terminal comprises a gate of the transistor.

11. A method for control of current rise time during multiple fuel injection events, comprising the steps of:

a) providing a solenoid-operated fuel injector;

b) providing a boost voltage supply;

c) sensing a voltage proportional to a current flowing in the solenoid;

d) generating a boost modulation reference voltage pulse having an envelope proportional to a desired solenoid current pulse;

e) comparing the sensed voltage to the reference voltage pulse;

f) coupling the boost voltage supply to the solenoid whenever the reference voltage pulse exceeds the sensed voltage; and de-coupling the boost voltage supply from the solenoid whenever the sensed voltage exceeds the reference voltage pulse, wherein a rise-time and shape of an actual solenoid current pulse is forced to track the desired solenoid current pulse between zero and a peak current.

12. The method of claim 11, wherein step (c) comprises the steps of:

c.1) providing a sense resistor operative to sink a current flowing through the solenoid to ground; and c.2) sensing a voltage across the sense resistor, wherein the sensed voltage is proportional to the current flowing through the solenoid.

13. The method of claim 11, wherein step (b) comprises providing a boost voltage supply capacitor.

14. The method of claim 13, wherein step (b) further comprises providing a boost voltage supply capacitor capable of storing at least twice an amount of energy required to pull in the solenoid.

15. The method of claim 11, wherein step (f) further comprises the steps of:

f.1) providing a field effect transistor having a drain coupled to the boost voltage supply and a source coupled to the solenoid; and f.2) activating a gate of the field effect transistor whenever the reference voltage pulse exceeds the sensed voltage.

16. The method of claim 15, wherein step (g) comprises de-activating the gate of the field effect transistor whenever the sensed voltage exceeds the reference voltage pulse.

* * * * *

UNITED STATES PATENT AND TRADEMARK OFFICE
CERTIFICATE OF CORRECTION

PATENT NO : 6,031,707

DATED : February 29, 2000

INVENTOR(S) : William D. Meyer

It is certified that error appears in the above-identified patent and that said Letters Patent is hereby corrected as shown below:

Title page, item [54],

In the Abstract, line 15, please delete "nninimum" and insert in lieu thereof --minimum--.

In column 3, line 21, please delete "ejector" and insert in lieu thereof --injector--.

In column 5, line 33, please delete "I" after the word "benefit".

Signed and Sealed this

Twentieth Day of March, 2001

*Attest:*

Nicholas P. Godici

NICHOLAS P. GODICI

*Attesting Officer*

*Acting Director of the United States Patent and Trademark Office*